US010118179B2

(12) United States Patent
Tschetter et al.

(10) Patent No.: US 10,118,179 B2
(45) Date of Patent: Nov. 6, 2018

(54) BALL MILL FOR MALLEABLE MATERIAL RECOVERY

(71) Applicant: Lankota Group, Inc., Huron, SD (US)

(72) Inventors: Lance C. Tschetter, Huron, SD (US); Dakota R. Tschetter, Huron, SD (US); Colin H. Treeby, Rapid City, SD (US)

(73) Assignee: LANKOTA GROUP, INC., Huron, SD (US)

( * ) Notice: Subject to any disclaimer, the term of this patent is extended or adjusted under 35 U.S.C. 154(b) by 166 days.

(21) Appl. No.: 14/802,428

(22) Filed: Jul. 17, 2015

(65) Prior Publication Data

US 2017/0014829 A1 Jan. 19, 2017

(51) Int. Cl.
*B02C 17/02* (2006.01)
*B02C 17/18* (2006.01)

(52) U.S. Cl.
CPC ..... *B02C 17/02* (2013.01); *B02C 17/1855* (2013.01); *B02C 17/1875* (2013.01)

(58) Field of Classification Search
CPC . B02C 17/02; B02C 17/1855; B02C 17/1875; B02C 15/00; B02C 15/001; B02C 17/00; B02C 17/04; B02C 17/06; B02C 17/161; B02C 17/182; B02C 17/183; B02C 17/20; B07B 1/18; B07B 1/22; B07B 1/288; B07B 1/46; B24C 3/26; B24C 31/00
USPC ..... 241/74, 171–184, 3, 101.04, 49, 57; 451/85, 328
See application file for complete search history.

(56) References Cited

U.S. PATENT DOCUMENTS 3,862,719 A * 1/1975 Muller ..... B22C 5/04 241/180
4,085,898 A * 4/1978 Jacubasch ..... B02C 17/14 241/175
4,252,280 A * 2/1981 Rymer ..... B02C 17/02 241/285.2
4,373,675 A * 2/1983 Kaufman ..... B02C 17/02 241/23
4,801,100 A * 1/1989 Orlando ..... B02C 17/183 141/284
4,926,601 A * 5/1990 Musschoot ..... B01F 11/0094 241/183
5,143,305 A * 9/1992 Dunham ..... A01B 43/00 209/234
5,158,238 A * 10/1992 Lehman ..... B03B 9/00 177/1
5,660,340 A * 8/1997 Baughman ..... A23B 4/07 241/172
5,727,740 A * 3/1998 Robinson ..... B03B 5/02 241/20

(Continued)

OTHER PUBLICATIONS

"Ball Mill." Wikipedia. Wikimedia Foundation, Jun. 22, 2015. <https://en.wikipedia.org/wiki/Ball_mill>.

*Primary Examiner* — Jessica Cahill
*Assistant Examiner* — Joseph Finan, Jr.
(74) *Attorney, Agent, or Firm* — David D. Brush; Westman, Champlin & Koehler, P.A.

(57) ABSTRACT

An apparatus for separating material includes a frame and a rotatable sleeve supported by the frame. The sleeve has a first end, a second end, and a wall with a plurality of apertures to permit material smaller than a first size to fall through the apertures. A source of forced air is arranged to force air through an interior of the sleeve.

14 Claims, 12 Drawing Sheets

(56) References Cited

U.S. PATENT DOCUMENTS

| | | | | |
|---|---|---|---|---|
| 6,199,779 | B1 * | 3/2001 | Mosher | B02C 17/04 241/19 |
| 7,399,141 | B2 * | 7/2008 | Benjamin | B03B 9/02 405/128.75 |
| 8,308,906 | B2 * | 11/2012 | Page | B02C 17/1855 162/232 |
| 2013/0026267 | A1 * | 1/2013 | Roh | B02C 17/04 241/37.5 |
| 2013/0181077 | A1 * | 7/2013 | Harris | B02C 23/10 241/38 |
| 2013/0230720 | A1 * | 9/2013 | Levanduski | C21B 11/06 428/403 |
| 2014/0117124 | A1 * | 5/2014 | Brosseuk | B03B 5/26 241/20 |

* cited by examiner

BALL MILL FOR MALLEABLE MATERIAL RECOVERY

BACKGROUND

Firing ranges or gun ranges are training or practice areas where firearms are fired at targets. When a weapon is fired, a projectile is propelled out of the weapon and lands down range near the target. Outdoor ranges are typically built with a dirt berm positioned behind the targets so that projectiles that miss the targets become embedded in the berm and do not strike unintended objects or persons. Projectiles can also become embedded in the ground beneath or around the target.

Some projectiles have been made and continue to be made with lead. As a result, the ground at firing ranges is often contaminated with lead.

The discussion above is merely provided for general background information and is not intended to be used as an aid in determining the scope of the claimed subject matter. The claimed subject matter is not limited to implementations that solve any or all disadvantages noted in the background.

SUMMARY

An apparatus for separating material includes a frame and a rotatable sleeve supported by the frame. The sleeve has a first end, a second end, and a wall with a plurality of apertures to permit material smaller than a first size to fall through the apertures. A source of forced air is arranged to force air through an interior of the sleeve.

A ball screen apparatus includes a rotatable sleeve having a material introduction opening and a side wall with a plurality of apertures forming a screen. The plurality of apertures are sized to permit material smaller than a first size to fall through the plurality of apertures. A plurality of balls is located within an interior of the rotatable sleeve. A source of forced air is arranged to force air through the interior of the rotatable sleeve.

A method of recovering material includes: placing material within a ball screen comprising sleeve having a plurality of apertures and a plurality of balls within an interior of the sleeve; rotating the ball screen to crush portions of the material to a size that allows the crushed material to pass through the plurality of apertures; and discharging material remaining in the ball screen from the ball screen.

In a further embodiment, an assembly is provided that includes a ball screen having a material introduction end and an opposing material exit end and having a screen surface between the material introduction end and the material exit end. The ball screen is configurable to crush some material between the material introduction end and the material exit end to produce crushed material that falls through the screen surface and to press other material without crushing the other material, which exits the material exit end.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Embodiments described below provide a system for separating malleable material, such as lead, from other materials found at a firing range such as paper wading, sticks, grass, rocks, and dirt. Once separated, the malleable material can be collected and recycled.

Figure 1:
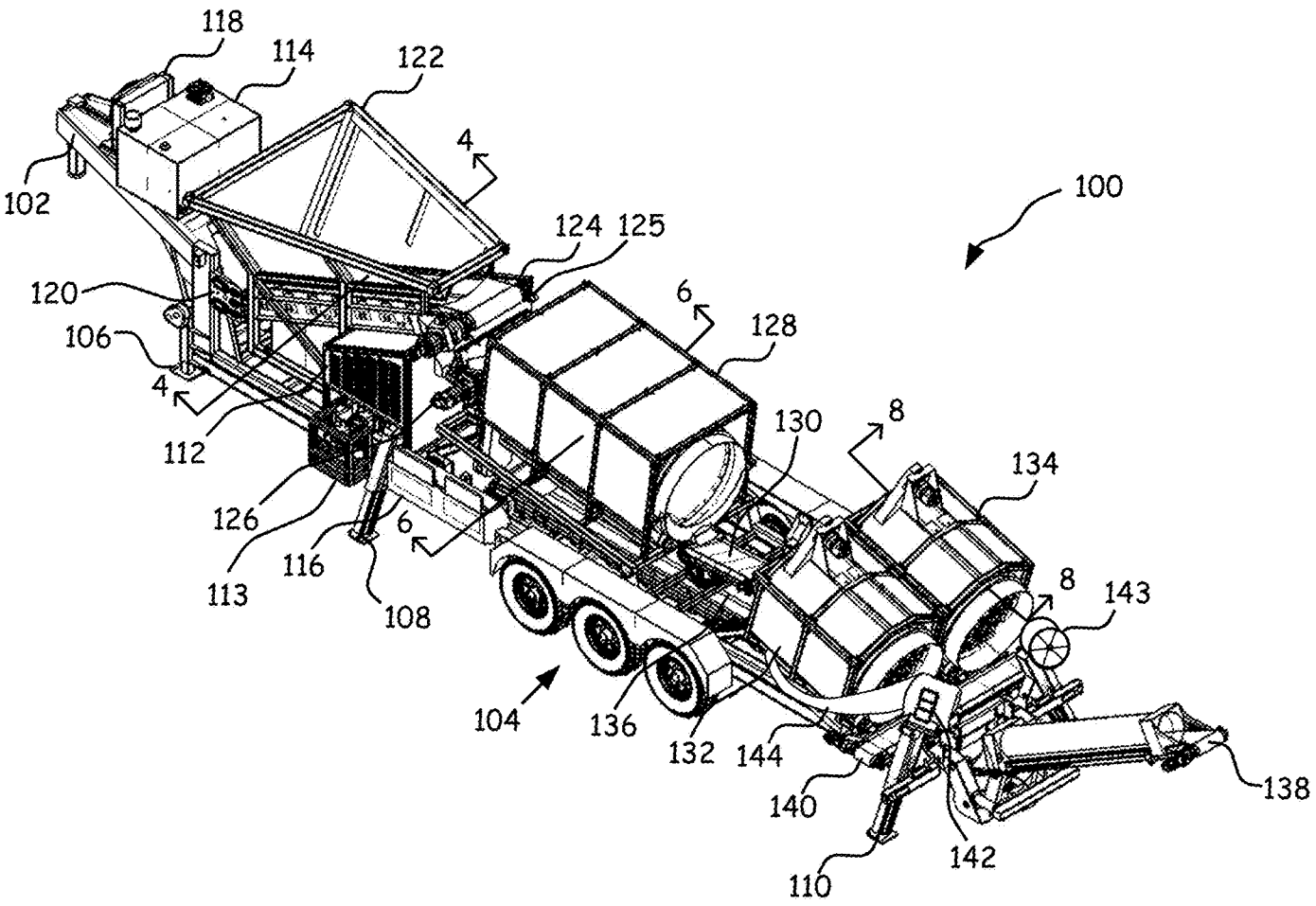
FIG. 1 is a perspective view of a malleable material recovery system.
Figure 2:
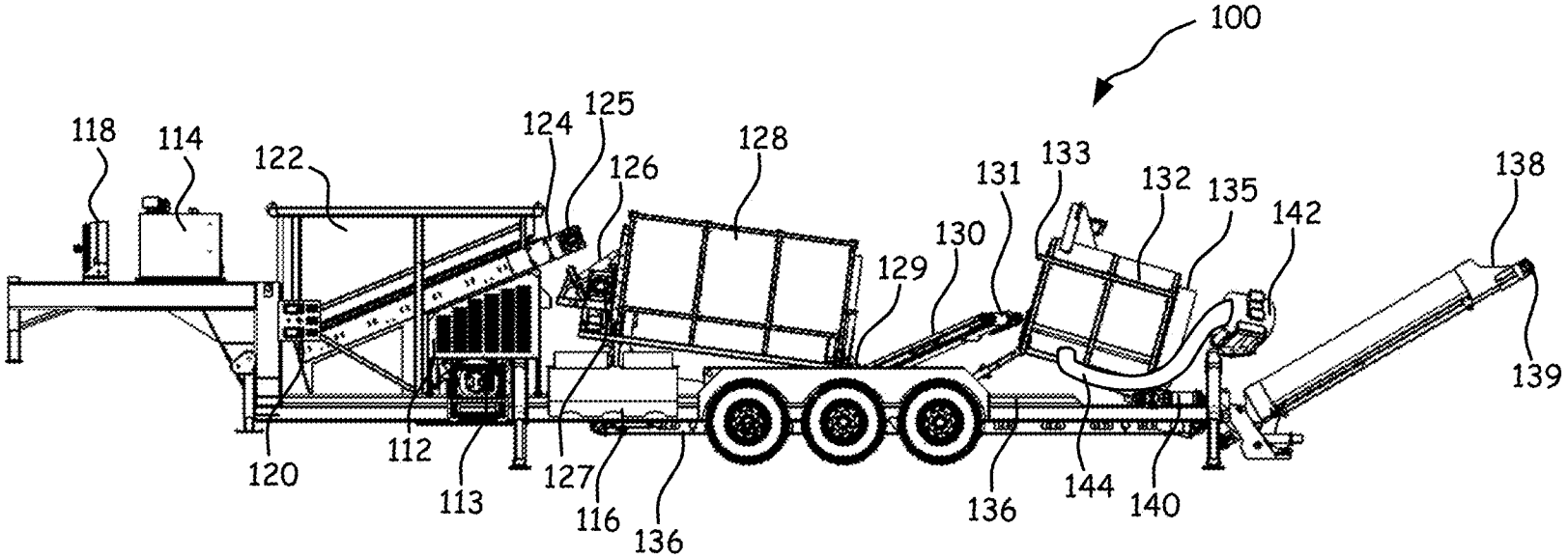
FIG. 2 is a side view of the system of FIG. 1.

FIG. 1 provides a perspective view and FIG. 2 provides a side view of a system 100, in accordance with one embodiment, for recovering lead from a firing range. In the embodiment of FIGS. 1 and 2, system 100 is shown to be mounted on a trailer frame 102 having multiple wheels 104. Trailer 102 is capable of being pulled by a semi-tractor or other vehicle (not shown) so that it can be moved onto the firing range. In other embodiments, the components of system 100 can be mounted within a building or exterior to a building, and dirt and soil from a firing range can be brought to the system for recovery of any lead contained in the material. By mounting the components of system 100 on trailer 102, the material from the firing range does not need to be hauled over long distances.

Once system 100 has been positioned at the firing range, it is stabilized by using trailer dollies, such as trailer dolly 106, and downriggers, such as downriggers 108 and 110.

System 100 includes a number of hydraulic motors and pistons that are driven by hydraulic oil. A diesel engine 112 drives hydraulic pumps 113 to pressurize the hydraulic oil. A hydraulic oil reservoir 114 contains an extra supply of hydraulic oil, and a hydraulic oil cooler 118 cools the hydraulic oil. Valve bodies 116, which are controlled by electronics in a control panel 120, direct the hydraulic oil to the various motors and pistons to thereby control the speed at which the motors turn and to control the extent that the pistons are expanded or contracted. The speeds of the various motors may be controlled independently of each other and are set by control panel 120 to ensure a continuous flow of material through system 100 without material spilling from the components of system 100.

Material from the firing range is dumped into hopper 122 using earth moving machinery such as a front-end loader or excavator. Hopper 122 includes an open bottom that is positioned over hopper conveyor 124. Material placed in hopper 122 is carried upward by hopper conveyor 124 and over an end 125 where it pours into a crusher 126. Crusher 126 includes a plurality of rotating, spaced teeth that crush rocks and other hard material into smaller pieces. These smaller pieces pass into trommel screen 128, which includes a rotating sleeve having one or more screens. The sleeve rotates within an outer frame and is pitched at an angle that causes the material to move from an entrance 127 (FIG. 2)

of trommel screen 128 to an exit 129 of trommel screen 128. As the material passes from entrance 127 to exit 129, fine material falls through the screens of the sleeve and onto smalls conveyor 136, which extends below trommel screen 128. A shoot or spout 514 (FIG. 5) at exit 129 of trommel screen 128 directs larger material onto a bigs conveyor 130, which is a pivoting or oscillating conveyor. Conveyor 130 alternates between conveying material into a first ball screen 132 and conveying material into a second ball screen 134 by alternately positioning an end 131 of the conveyor in front of an entrance to ball screen 132 and an entrance to ball screen 134. The system 100 may be configured to position end 131 automatically under the control of control panel 120 or so that the end 131 is moved manually by an operator of the system.

Ball screens 132 and 134 are connected to respective fans 142 and 143 by air conduits such as air conduit 144. As described further below, each ball screen 132/134 includes an interior rotating sleeve formed of a screen or perforated material and containing freely moving, crushing objects such as a plurality of stainless steel balls. As the sleeve is rotated, the freely moving objects move up along the side of the sleeve and then fall down upon the material introduced into a material introduction end 133. As the freely moving objects fall, the objects crush the material into smaller pieces. These smaller pieces fall through the screen material of the sleeve and onto smalls conveyor 136, which runs below ball screens 132 and 134. The material on smalls conveyor 136 is provided to a pivoting discharge conveyor 138, which is pivoted from side-to-side while material discharges at an end 139 to provide a pile of cleaned material that can be returned to the firing range. Fans 142 and 143 blow air through the air conduits, such as air conduit 144 and into ball screens 132 and 134. The airstream passes through the screen material of the sleeve and causes light material such as sticks, garbage, and paper wading to be blown out of the ball screens through the material introduction end 133.

When all the light material has been blown out of material introduction end 133 and all of the crushable material has been crushed into fine-enough particles to fall through the screen of the sleeve, the only material remaining in ball screens 132 and 134 is malleable material that, instead of being crushed, is pressed or otherwise deformed by the freely moving objects. This malleable material is too large to pass through the apertures in the screens of the ball screens. To remove this material from the ball screens, gates at a material exit end 135 are opened to provide discharge openings that are larger than the openings in the screen but smaller than the smallest freely-moving object (e.g., steel ball) contained in the ball screen. As the sleeve rotates, the malleable material, such as lead, travels toward material end 135 and exits through the openings and onto a malleable material conveyor 140. Malleable material conveyor 140 directs the malleable material to containers (not shown) at the sides of trailer 102. Thus, the malleable material, such as lead, is separated from the crushable material and the light-weight material found on the firing range to thereby recover the lead material from the firing range and recover the lead for safe disposal or for reuse.

Figure 3:
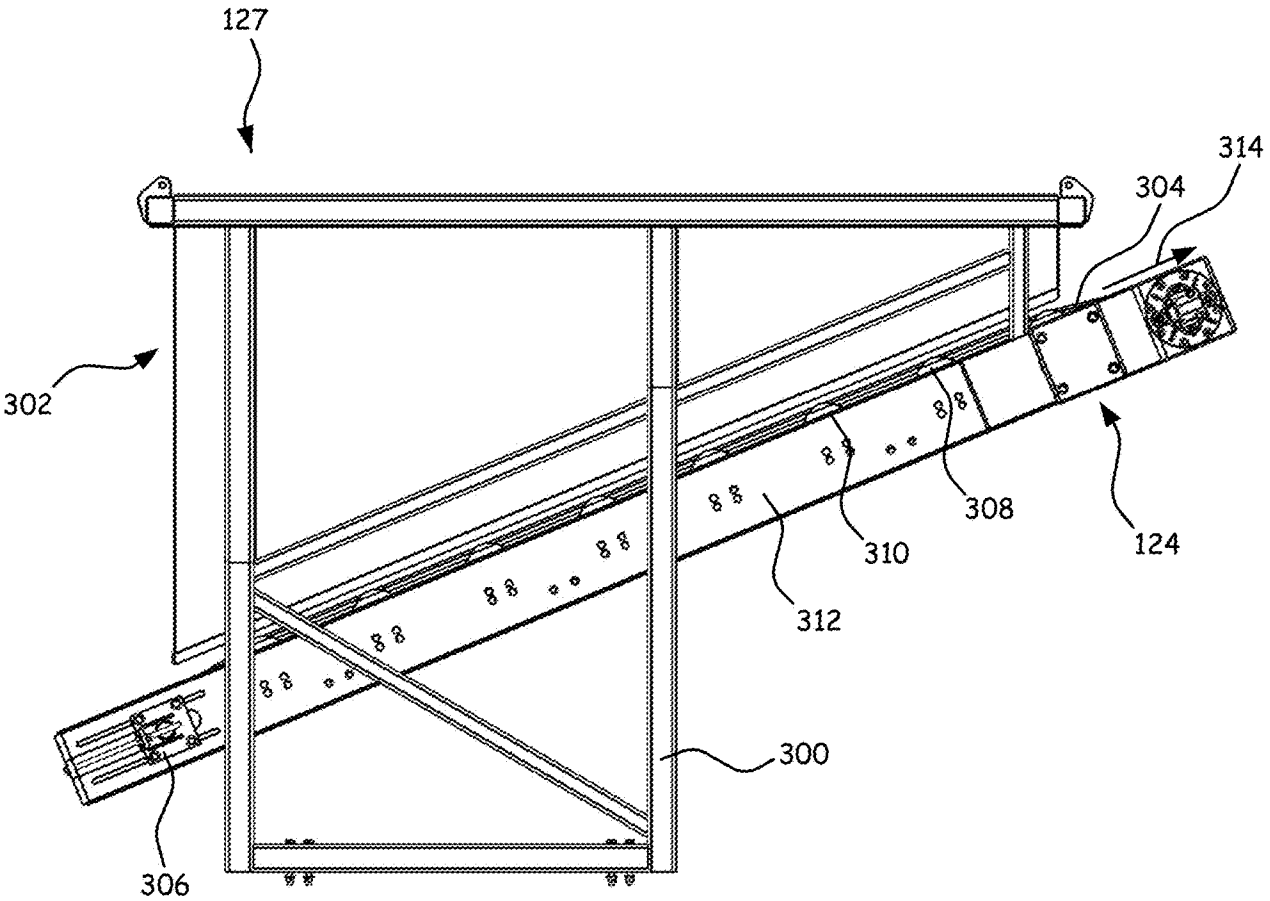
FIG. 3 is an enlarged side view of the hopper and conveyor.

FIG. 3 provides an expanded side view of hopper 122 and hopper conveyor 124. Hopper 122 includes a hopper frame 300 that supports hopper walls 302. As shown in the sectional view of FIG. 4 taken through lines 4-4 of FIG. 1, hopper walls 302 include slanted sidewalls 400 and 402 and vertical back wall 403. Hopper 122 also includes an open bottom 410 that opens onto hopper conveyor 124. Slanted sidewalls 400 and 402 and vertical back wall 403 direct material dropped into hopper 122 onto hopper conveyor 124.

Figure 4:
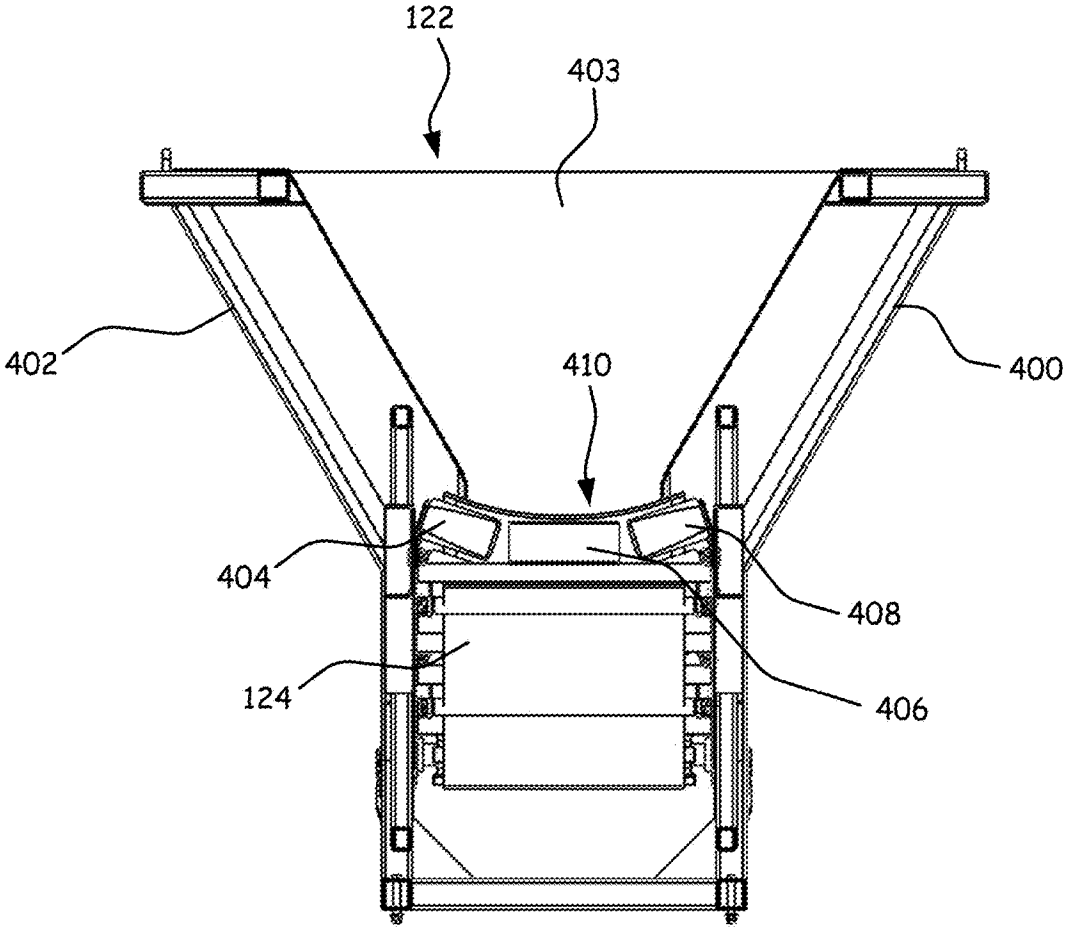
FIG. 4 is a sectional view of the system of FIG. 1 taken through lines 4-4 and showing the hopper and conveyor.

Hopper conveyor 124 includes a conveyor belt 304, which rolls over rollers, such as rollers 308 and 310 that are supported by a conveyor frame 312. A hydraulic conveyor motor 306 drives conveyor belt 304 in a direction 314. As shown in FIG. 4, the rollers include side rollers 404 and 408, which are angled relative to a center roller such as center roller 406. This construction forms a depression in conveyor belt 304 designed to maintain the material on the conveyor belt.

Figure 5:
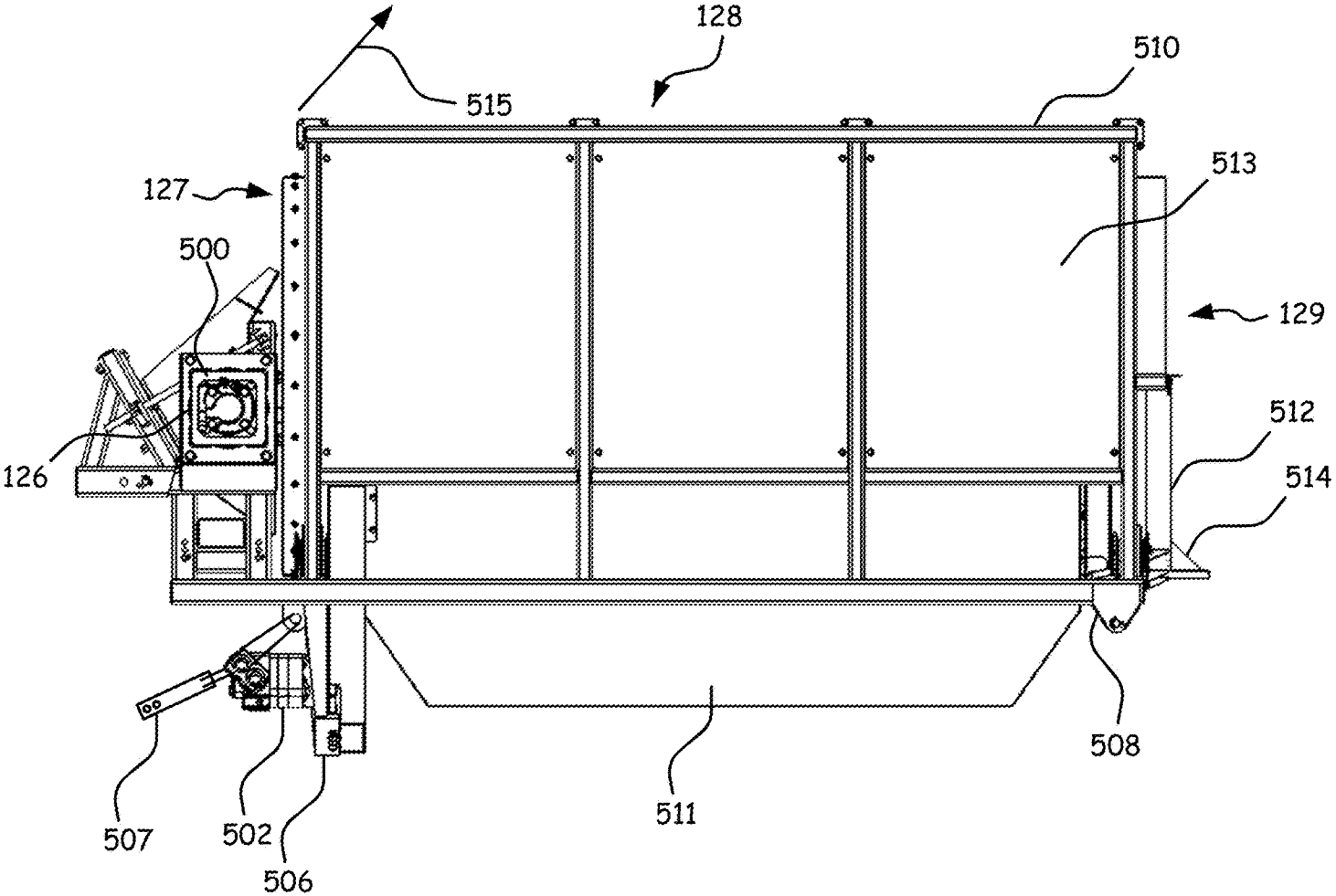
FIG. 5 is a side view of the crusher and trommel screen.
Figure 6:
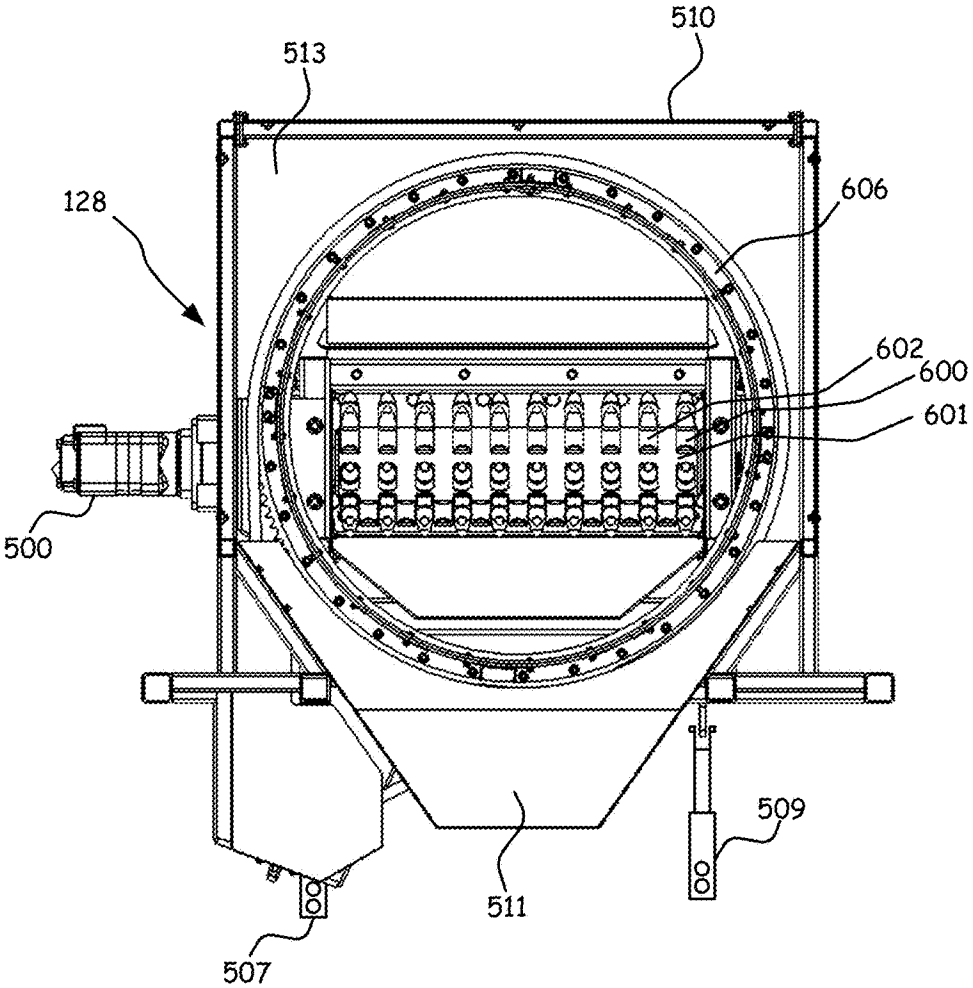
FIG. 6 is a sectional view of the system of FIG. 1 taken through lines 6-6 showing the crusher and trommel screen.

FIG. 5 shows an enlarged side view of crusher 126 and trommel screen 128 and FIG. 6 shows a sectional view of system 100 through lines 6-6 of FIG. 1 showing trommel screen 128 and crusher 126. Trommel screen 128 is defined by a frame 510 that supports a set of dust covers, such as dust cover 513, a funnel 511, a motor mount 506 and crusher motor 500 of crusher 126. Motor mount 506 supports trommel motor 502. As shown in FIG. 6, trommel motor 502 rotates a rotating screen 606. Trommel screen 128 and crusher 126 can be pivoted vertically about a point 508 in a pivot direction 515 by two hydraulic pistons 507 and 509 that are controlled by control panel 120.

Crusher 126 includes a rotating cylinder 601 (FIG. 6) having protruding teeth such as teeth 600 and 602. Rotating cylinder 601 is driven by crusher motor 500 and crushes material as it falls off of conveyor belt 304 of FIG. 3. The crushed material enters rotating screen 606 and is transported from entrance end 127 to exit end 129 due to the force of gravity due to the angle of inclination formed by pivoting trommel screen 128 vertically in pivot direction 515. At exit end 129, frame 510 supports a partial wall 512 and spout 514. An opening in partial wall 512 opens onto spout 514 thereby allowing material to exit trommel screen 128 in a controlled manner.

As the material moves through trommel screen 128, material smaller than the apertures in rotating screen 606 fall through the screen and are directed by funnel 511 onto conveyor belt 136. As a result, only material that is larger than the apertures in rotating screen 606 passes out exit end 129 through spout 514.

Figure 7:
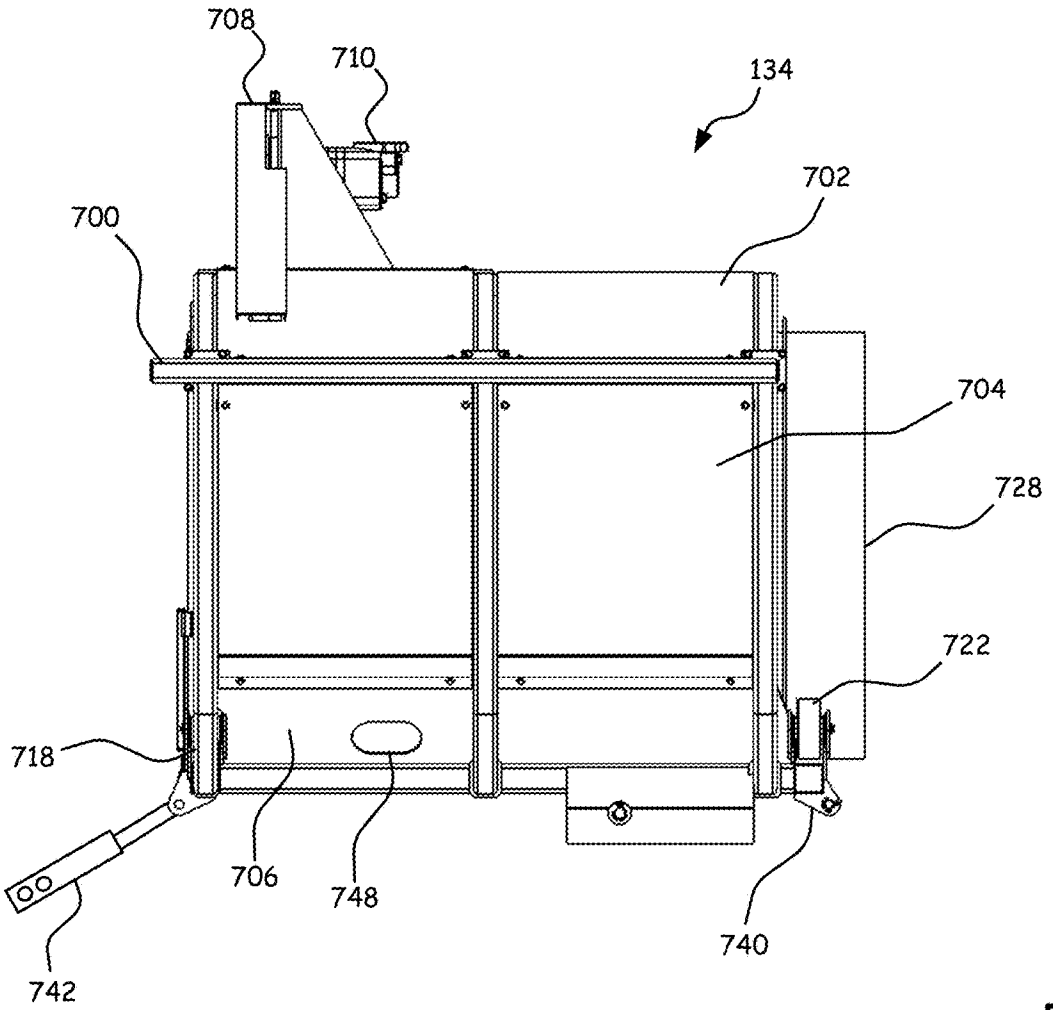
FIG. 7 is a side view a ball screen.
Figure 8:
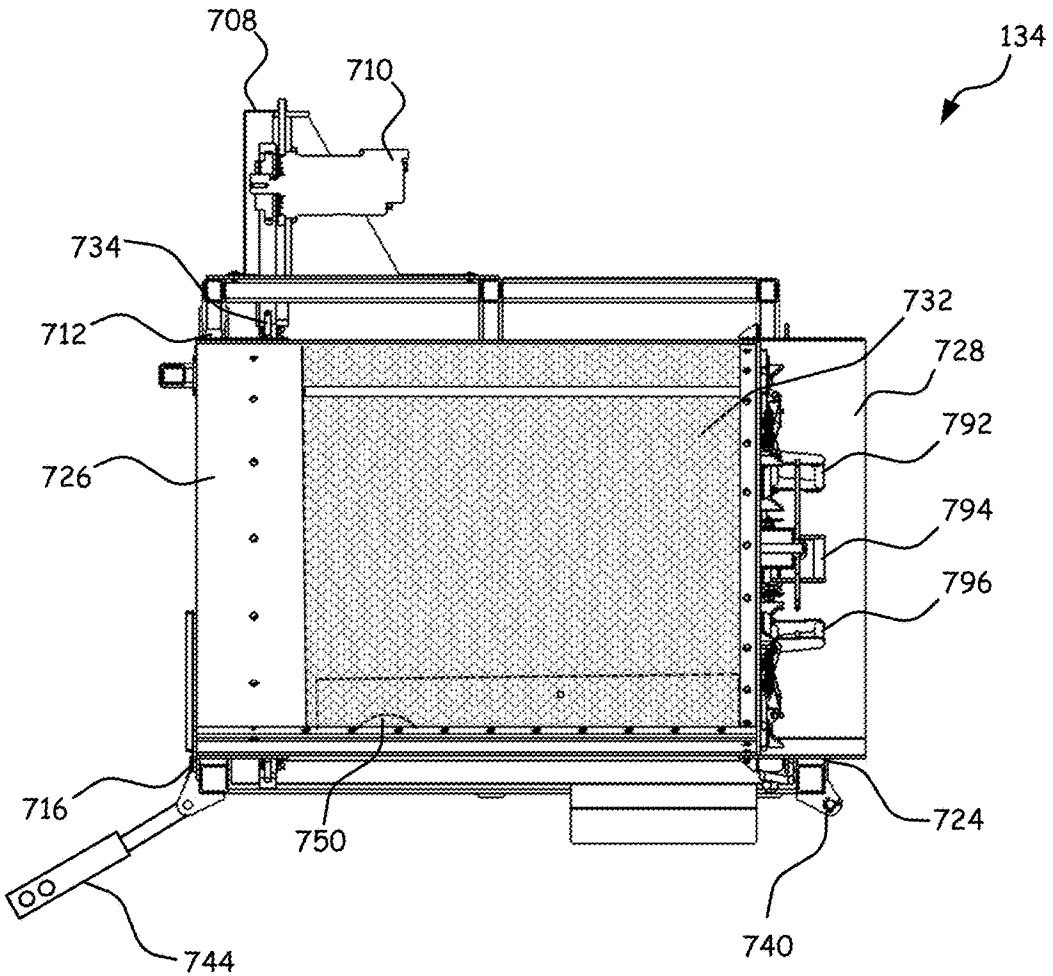
FIG. 8 is a sectional view of a ball screen through lines 8-8 of FIG. 1.
Figure 9:
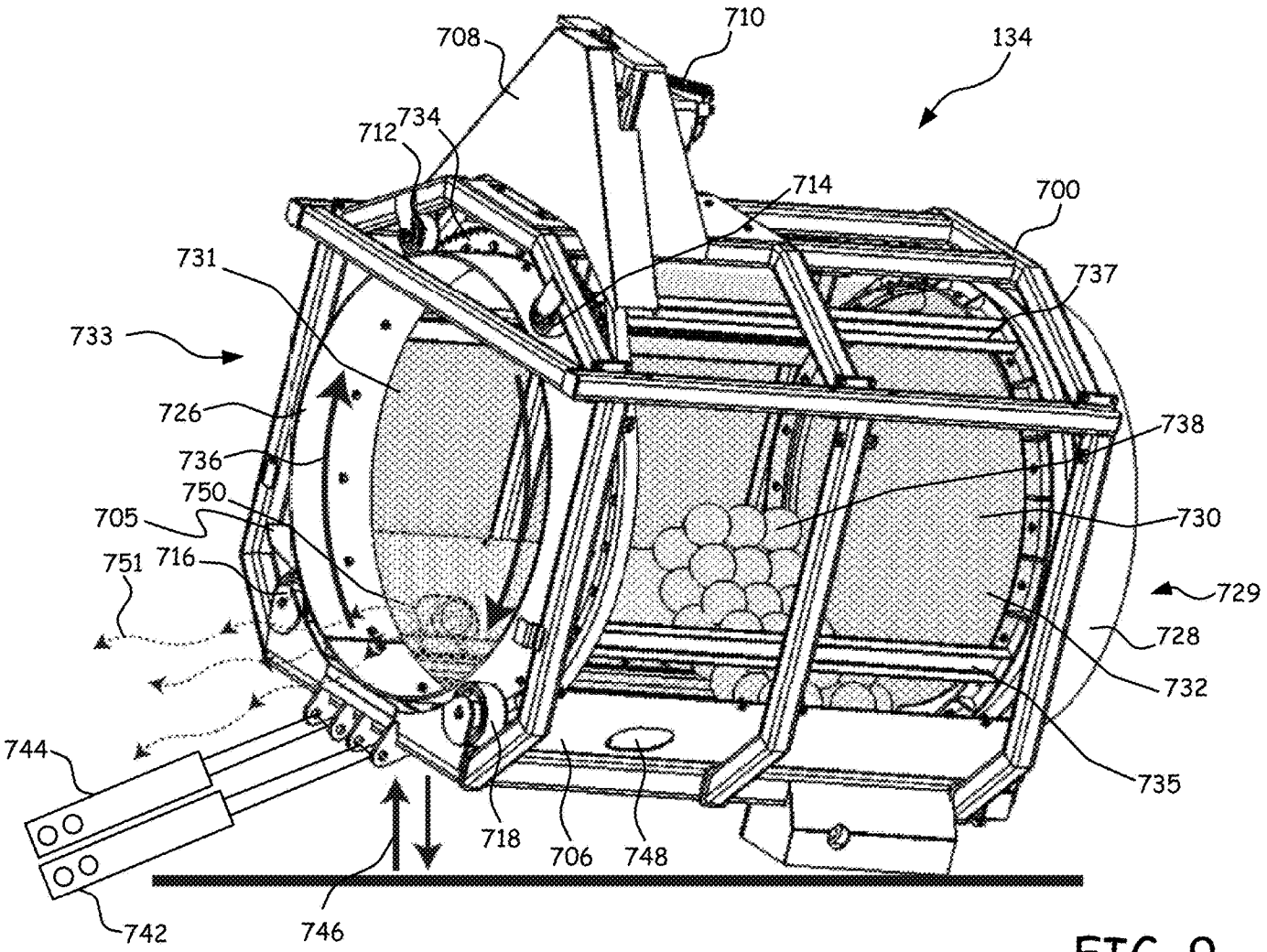
FIG. 9 is perspective view of a ball screen.
Figure 10:
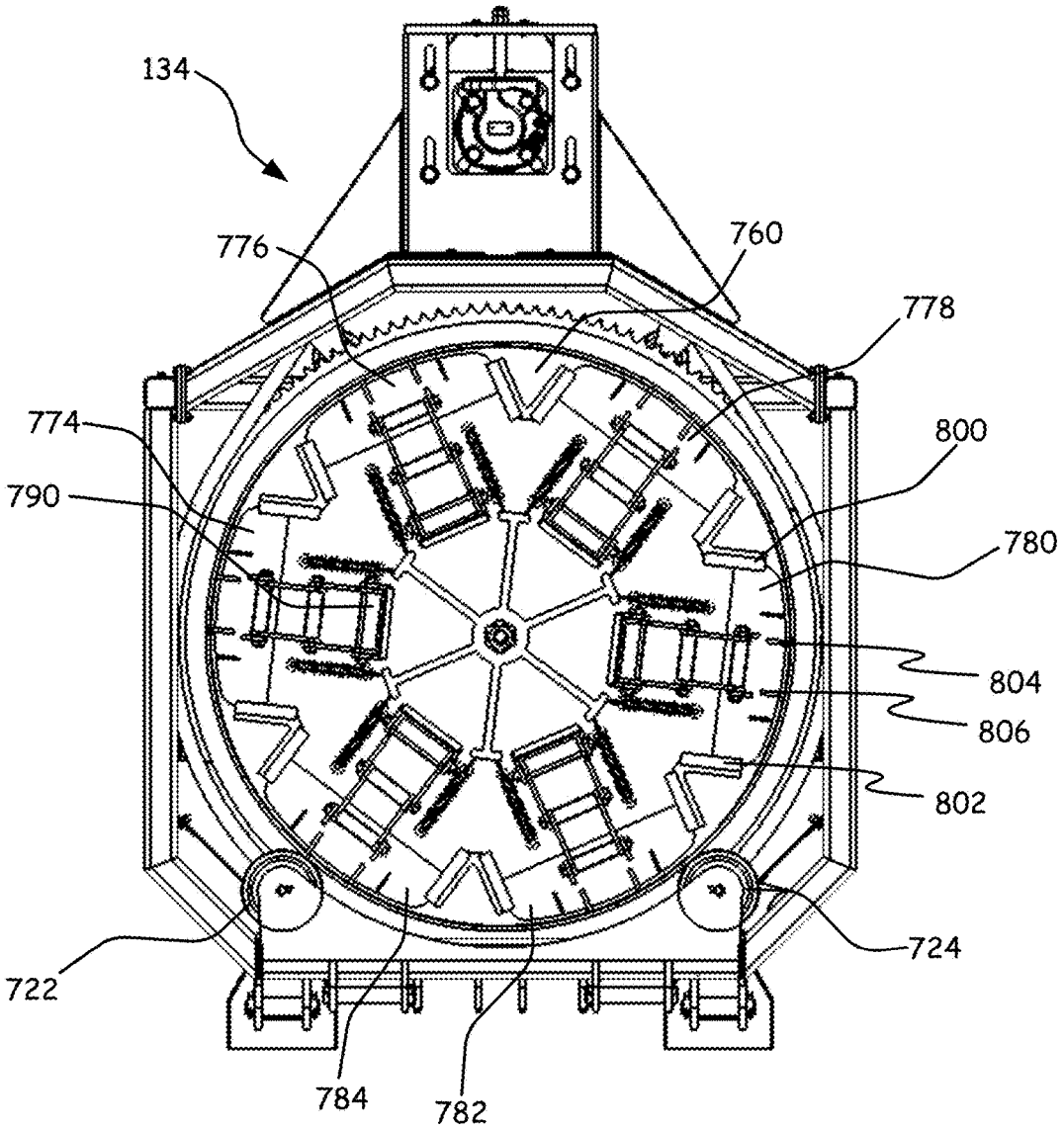
FIG. 10 is a back view of the ball screen.
Figure 11:
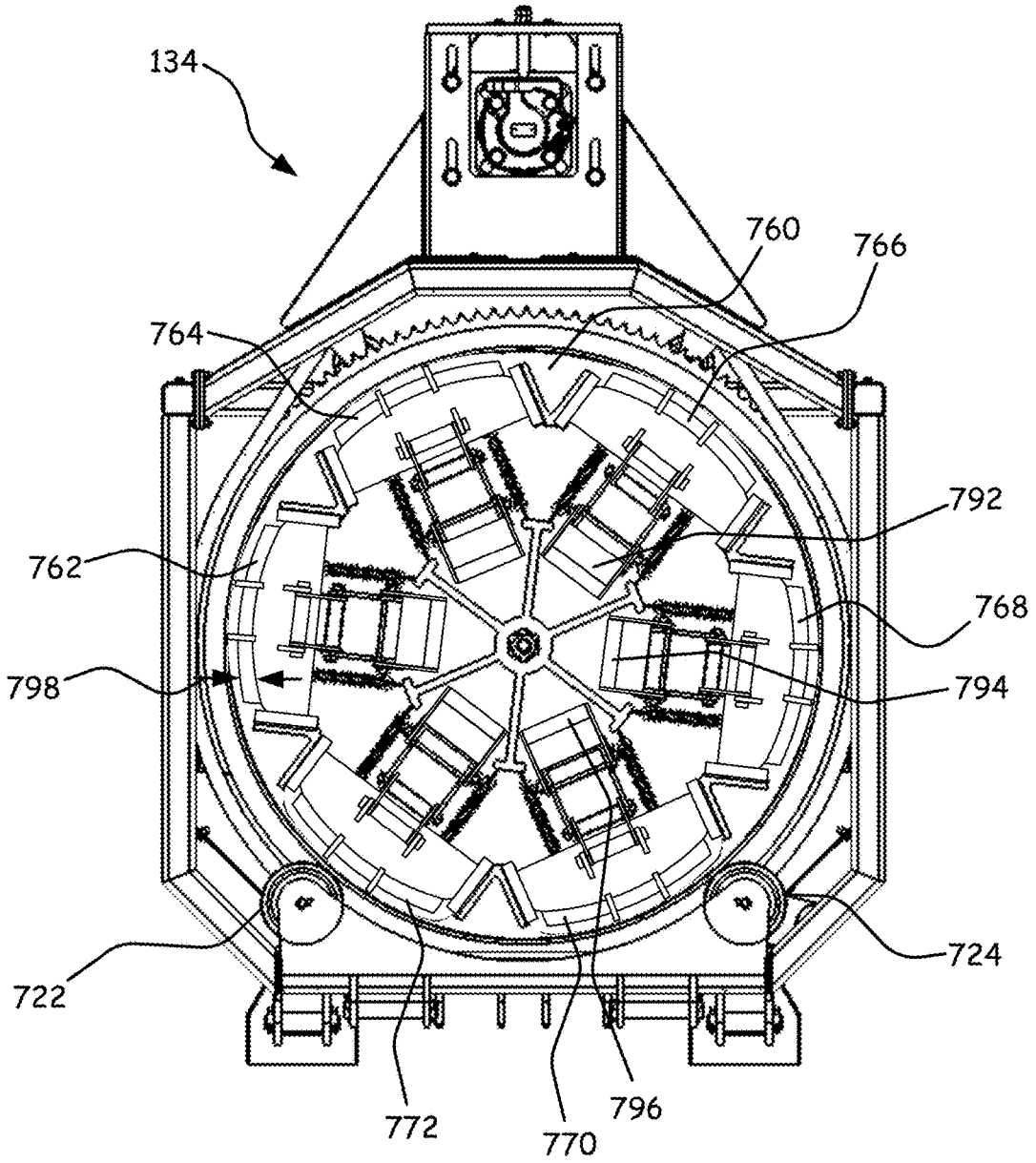
FIG. 11 is a back view of the ball screen with the gates open.

FIG. 7 provides a side view of ball screen 134, FIG. 8 provides a sectional view of ball screen 134 through lines 8-8 of FIG. 1, and FIG. 9 provides a perspective view of ball screen 134 with the dust covers over the top of the ball screen removed. FIGS. 10 and 11 show rear views of ball screen 134 with rear gates opened and closed, respectively As shown in FIGS. 7 and 9, ball screen 134 includes an outer frame 700 that supports a number of dust covers such as dust covers 702, 704, 705 and 706. In FIG. 9, the dust covers other than dust covers 705 and 706 have been removed to show the interior of ball screen 134. Frame 700 also supports a motor mount 708 that in turn supports a motor 710. Roller wheels, such as roller wheels 712, 714, 716, 718, 722 and 724 are also supported on frame 700. Roller wheels 712, 714, 716 and 718 support and engage with an entrance cylindrical support 726 which defines an opening 731 of a material introduction end or first end 733 of ball screen 134. Roller wheels 722 and 724 support an exit cylindrical support 728 at a material exit end or second end 729 of ball screen 134. Entrance cylindrical support 726 also includes a ring gear 734 that is engaged by a gear coupled to motor 710 to thereby allow motor 710 to rotate entrance cylindrical support 726 in a direction 736. When entrance cylindrical support 726 rotates, roller wheels 712, 714, 716 and 718 also rotate as does exit cylindrical support 728. Similarly, when exit cylindrical support 728 rotates, roller wheels 722 and 724 rotate.

A sleeve 730 extends between entrance cylindrical support 726 and exit cylindrical support 728. Sleeve 730 comprises a sleeve surface or screen surface 732 and one or more sleeve supports such as sleeve supports 735 and 737, shown in FIG. 9. Screen surface 732 has apertures that allow material smaller than the apertures to fall through sleeve 730. In accordance with some embodiments, screen surface 732 is cylindrical, however, screen surface 732 can have any desired shape. In the embodiment of FIG. 9, screen surface 732 is shown as a screen mesh or woven screen. In other embodiments, screen surface 732 is a sheet material that has been perforated to form the apertures. The apertures may have any shape and may be arranged in any suitable pattern. In accordance with one embodiment, the apertures are ¼ inch across. However, other sized apertures are used in other embodiments depending on the size of the malleable material to be recovered, for example. Also, the apertures may be distributed over the entire circumferential wall of sleeve 730 or may be limited to certain areas.

Within sleeve 730, freely moving objects 738, also referred to as crushing objects, are carried up screen surface 732 by the rotation 736 of sleeve 730 and friction between the sleeve and the objects. As the freely moving objects move up the sides of sleeve 730, they eventually fall back toward to the bottom of sleeve 730 thereby crushing material as they fall. Freely moving objects 738 are constructed as metal balls in some embodiments, but may be constructed from any desirable material including rubber, flint pebbles or ceramic. Further, freely moving objects 738 may have any desired shape. In accordance with one embodiment, freely moving objects 738 are 1-3.5 inches in diameter. In other embodiments, freely moving objects 738 have other sizes. Freely moving objects 738 may all have the same size or have a plurality of different sizes. Freely moving objects 738 break some of the material introduced through the material introduction end into a plurality of smaller pieces while deforming other material introduced through the material introduction end without breaking the other material into a plurality of smaller pieces.

Ball screen 134 can be pivoted vertically along a pivot 740 using hydraulic pistons 742 and 744 that are attached near material introduction end 733. Hydraulic pistons 742 and 744 act as adjustable supports attached to the outer frame such that an inclination angle between screen surface 732 of sleeve 730 from first end 733 to second end 729 and a horizontal plane can be changed by adjusting the adjustable supports 742 and 744. As a result, material introduction end 733 may be moved in a vertical direction 746 relative to material exit end 729 thereby causing material introduced through material introduction end 733 to move toward material exit end 729 where it can be crushed by freely moving objects 738. The degree to which material introduction end 733 is lifted relative to material exit end 729 is controlled through control panel 120. The speed at which sleeve 730 is rotated is also controlled by control panel 120 through motor 710.

Two air conduit ports 748 and 750 are provided in dust guards 706 and 705, respectively, and are coupled to conduits such as air conduit 144 to channel air blown by fan 143 through screen surface 732, into the interior of sleeve 730, and out from opening 731 in an air flow direction 751. Air flow direction 751 includes a vertical component designed to lift light-weight material and a lateral component designed to push the light-weight material toward opening 731. The air flow through air conduit ports 748 and 750 is sufficient to blow light-weight material out of opening 731.

Material exit end 729, as best shown in FIGS. 10 and 11, includes a closed surface 760 having a plurality of openings such as openings 762, 764, 766, 768, 770 and 772. Each opening can be opened and closed by a respective gate, such as gates 774, 776, 778, 780, 782 and 784. Each gate forms part of a closure that includes a handle connected to the gate by multiple linkages and springs that maintain the gate in an open position when the gate is open and in a closed position when the gate is closed. For example, the closures can include handles, such as handles 790, 792, 794 and 796. Each gate is supported on closed surface 760 by a set of guides such as guides 800, 802, 804 and 806 for gate 780 of FIG. 10. In FIG. 10, the closures are shown in the closed position and in FIG. 11, the closures are shown in the open position with the handles pulled toward the center of material exit end 729. When the handles are pulled radially toward the center, a center pivot point in the linkages is pulled upward thereby causing the last linkage to pull the respective gate radially inward toward the center. When the handle is pushed radially outward, the center pivot point drops thereby causing the gate to move radially outward through the action of the linkages.

When the gates are moved to the open position, the smallest dimension 798 of the openings is larger than the apertures in screen surface 732. Thus, material that is too large to pass through screen surface 732 is permitted to pass through openings 762, 764, 766, 768, 770 and 772. As a result, material that is not crushed by the freely moving objects 738 but instead is pressed due to its malleability, is allowed to exit through material exit end 729 via the openings. This malleable material can include, for example, lead. The largest dimension of the openings formed by the gates is slightly smaller than the smallest freely moving objects 738 in order to prevent these objects from passing through the openings.

Figure 12:
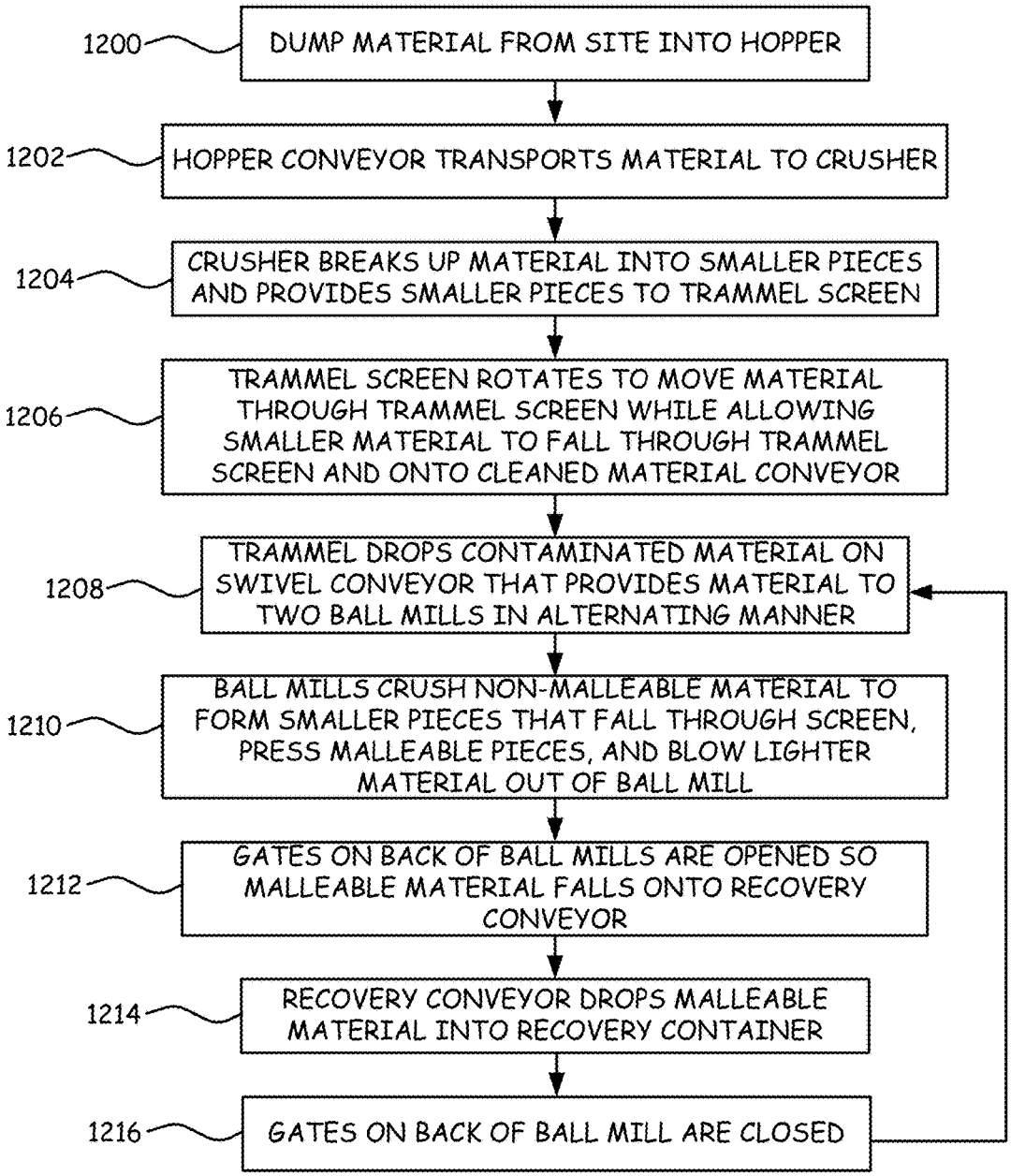
FIG. 12 is a flow diagram of a method of recovering malleable material in accordance with one embodiment.

FIG. 12 provides a flow chart of a method of recovering malleable material from a site. In step 1200, material from the site is dumped into hopper 122. At step 1202, the hopper conveyor 124 conveys the material to crusher 126. At step 1204, the crusher 126 breaks-up the material into smaller pieces and provides the smaller pieces to trommel screen 128. At step 1206, trommel screen 128 rotates to move the material through the trommel screen while allowing smaller material to fall through the trommel screen and onto smalls conveyor 136.

At step 1208, larger material that cannot fall through the trommel screen is dropped onto swivel conveyor 130 through spout 514 of trommel screen 128. Swivel conveyor 130 provides the material to one of the two ball screens 132 and 134 in an alternating manner. In accordance with one embodiment, swivel conveyor alternately fills each ball screen 132 and 134 to a maximum capacity at which the ball screen can still operate. At step 1210, ball screens 132 and 134 use motor 710 to rotate sleeve 730 thereby causing freely moving objects in the ball screen to crush non-malleable material into smaller pieces that fall through the screen surface 732. At the same time, the freely moving objects press malleable pieces while blowing lighter material out of opening 731 using air conducted through air conduction ports 748 and 750. When substantially all of the non-malleable material has been crushed and has exited through screen surface 732 and substantially all light-weight material has been blown out of opening 731, gates 774, 776, 778, 780, 782 and 784 are moved to create openings 762, 764, 766, 768, 770 and 772. Sleeve 730 is rotated while the gates are in the open position thereby causing the malleable material to exit through the openings and onto recovery conveyor 140. Note that the openings are sized such that freely moving objects 738 cannot exit through the gate openings.

At step 1214, the recovery conveyor drops the malleable material into a recovery container. At step 1216, when the malleable material has exited through the openings, the gates are reclosed at step 1216 and the method returns to step 1208 where the swivel conveyor provides new material to the ball screen.

Thus, hopper 122, crusher 126, and trommel screen 128 operate in a continuous mode while ball screens 132 and 134 operate in alternating batch modes, for example. While one of ball screens 132 and 134 is being filled with material, the other of ball screens 132 and 134 is completing the crushing of its material and later is having its handles moved to create openings 762, 764, 766, 768, 770 and 772 so that malleable material exits the ball screen. The rate at which material is conveyed by conveyors 124 and 130 and by trommel screen 128 is controlled to maximize the throughput of ball screens 132 and 134 while not exceeding the material handling capacity of ball screens 132 and 134 when those ball screens are operated in batch mode.

The speed of rotation of trommel screen 128 and of sleeve 730 of ball screens 132 and 134 may be adjusted based on the material and on the size of the freely moving objects 738 to maintain a high rate of crushing in the ball screens and to allow a high flow rate of material through the screen surfaces.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A method of recovering lead of firearm projectiles from a material, the method comprising:

providing a ball screen;

placing the material within the ball screen, the ball screen comprising a sleeve having a plurality of apertures, a material entrance end at one end of the sleeve, a closed material exit end at an opposite end of the sleeve, and a plurality of balls within an interior of the sleeve, the closed material exit end comprising at least one discharge opening that can be opened or closed, the material comprising firearm projectiles containing the lead, which are malleable and have a size that is larger than the plurality of apertures;

rotating the ball screen with the at least one discharge opening being closed to crush portions of the material to a size that allows the crushed material to pass through the plurality of apertures, and to cause the plurality of balls to press the lead of the firearm projectiles such that the lead remains larger than the plurality of apertures and remain within the interior of the sleeve;

forcing air through the interior of the ball screen during the act of rotating the ball screen in order to blow at least some of the material within the ball screen that is lighter than other material within the ball screen out an opening in the ball screen when crushing portions of the material; and discharging the lead remaining in the ball screen from the ball screen by opening the at least one discharge opening while further rotating the ball screen, the at least one discharge opening being larger than each of the plurality of apertures and smaller than a smallest one of the plurality of balls, to permit the lead that is larger than the apertures and smaller than the smallest of the plurality of balls, after performing the act of rotating, to fall through the at least one discharge opening while retaining the plurality of balls within the rotatable ball screen.

2. The method of claim 1 further comprising:

moving the material to the ball screen from a firing range.

3. The method of claim 1 further comprising:

using a conveyor beneath the sleeve to move the crushed material that passes through the apertures in the sleeve to a first location; and using a second conveyor below the at least one discharge opening to move material that exits through the discharge opening to a second location.

4. The method of claim 1, wherein the ball screen is inclined vertically downward from the material entrance end toward the material exit end.

5. The method according to claim 1, further comprising:

prior to placing the material in the ball screen, passing the material through a trommel screen such that fine portions of the material falls through the trommel screen and larger portions of the material pass though an exit of the trommel screen; and placing the larger portions of the material that exit the trommel screen in the ball screen.

6. The method of claim 1, wherein the act of forcing air through the interior of the sleeve comprises:

producing airstream from a fan; and orienting the airstream to have a vertical and lateral component so that the airstream passes through the sleeve and into the interior of the sleeve to cause light material to be blown out of the ball screen through the material entrance end.

7. The method of claim 1, further comprising:

placing further material within a further ball screen of the ball mill, the further ball screen comprising a further sleeve having a plurality of apertures and a further plurality of balls within an interior of the further sleeve, wherein the lead of the firearm projectiles has a size that is larger than the plurality of apertures of the further screen;

rotating the further ball screen to crush portions of the further material to a size that allows the crushed portions of the further material to pass through the plurality of apertures of the further screen, wherein rotating the further ball screen causes the further balls to press the lead of the firearm projectiles such that the lead remains larger than the plurality of apertures of the further screen and remains within the interior of the further sleeve with the further plurality of balls;

discharging the lead from the further ball screen while further rotating the further ball screen; and operating the ball screen and the further ball screen in alternating batch modes by:

operating a swivel conveyor to perform the act of placing the material within the ball screen and then rotating the ball screen while discharging the lead remaining in the further ball screen; and operating the swivel conveyor to perform the act of placing the material within the further ball screen and then rotating the further ball screen while discharging the lead remaining in the ball screen.

8. A method of recovering material, the method comprising:

providing a ball mill;

moving material to the ball mill, wherein the material comprises firearm projectiles that contain lead;

placing the material within a ball screen of the ball mill, the ball screen comprising a sleeve having a plurality of apertures and a plurality of balls within an interior of the sleeve, wherein the lead of the firearm projectiles has a size that is larger than the plurality of apertures;

rotating the ball screen to crush portions of the material to a size that allows the crushed portions of the material to pass through the plurality of apertures, wherein rotating the ball screen causes the balls to press the lead of the firearm projectiles such that the lead remains larger than the plurality of apertures and remains within the interior of the sleeve with the plurality of balls;

forcing air through the interior of the sleeve during the act of rotating the ball screen in order to blow at least some of the material within the ball screen that is lighter than other material within the ball screen out an opening in the ball screen when crushing portions of the material; and discharging the lead from the ball screen while further rotating the ball screen.

9. The method of claim 8, wherein the act of forcing air through the interior of the sleeve comprises:

producing an airstream from a fan; and orienting the airstream to have a vertical and lateral component so that the airstream passes through the sleeve and into the interior of the sleeve to cause light material to be blown out of the ball screen through a material entrance end of the ball screen.

10. The method of claim 8, wherein:

moving the material comprises moving ground material from a firing range to the ball mill; and the firearm projectiles that contain lead are projectiles in the ground material.

11. The method according to claim 8, further comprising:

prior to placing the material in the ball screen, passing the material through a trommel screen such that fine portions of the material falls through the trommel screen and larger portions of the material pass though an exit of the trommel screen; and placing the larger portions of the material that exit the trommel screen in the ball screen.

12. The method of claim 8, wherein:

the ball screen further comprises a material entrance end at one end of the sleeve and a closed material exit end at an opposite end of the sleeve, the closed material exit end comprising at least one discharge opening that can be opened or closed;

rotating comprises rotating the ball screen with the at least one discharge opening being closed; and discharging comprises opening the at least one discharge opening, the at least one discharge opening being larger than each of the plurality of apertures and smaller than a smallest one of the plurality of balls, to permit material that is larger than the apertures and smaller than the smallest of the plurality of balls after performing the act of rotating, to fall through the at least one discharge opening while retaining the plurality of balls within the rotatable ball screen.

13. The method of claim 12, wherein the ball screen is inclined vertically downward from the material entrance end toward the material exit end.

14. The method of claim 12 further comprising:

using a conveyor beneath the sleeve to move the crushed portions of the material that pass through the apertures in the sleeve to a first location; and using a second conveyor below the at least one discharge opening to move material, including the firearm projectiles that contain lead, which exit through the at least one discharge opening, to a second location.

* * * * *